US005433496A

United States Patent [19]

Zimmermann

[11] Patent Number: 5,433,496

[45] Date of Patent: Jul. 18, 1995

[54] MOTOR-VEHICLE DOOR LATCH WITH POWER ASSIST

[75] Inventor: Gerhard Zimmermann, Velbert, Germany

[73] Assignee: Kiekert GmbH & Co. KG, Heiligenhaus, Germany

[21] Appl. No.: 195,582

[22] Filed: Feb. 14, 1994

[30] Foreign Application Priority Data

Apr. 9, 1993 [DE] Germany ..... 43 11 785.6

[51] Int. Cl.[6] ..... E05C 3/26

[52] U.S. Cl. ..... 292/201; 292/DIG. 23

[58] Field of Search ..... 292/201, 198, DIG. 23

[56] References Cited

U.S. PATENT DOCUMENTS

| | | | |
|---|---|---|---|
| 4,364,249 | 12/1982 | Kleefeldt | 292/DIG. 23 |
| 4,979,384 | 12/1990 | Malesko et al. | 292/201 |
| 4,998,758 | 3/1991 | Kowalczyk et al. | 292/201 |
| 5,066,054 | 11/1991 | Ingenhoven | 292/201 |
| 5,074,603 | 12/1991 | Brackmann | 292/201 |
| 5,100,185 | 3/1992 | Menke et al. | 292/DIG. 23 |
| 5,232,253 | 8/1993 | Tamiya | 292/201 |
| 5,236,234 | 8/1993 | Norman | 292/201 |

*Primary Examiner*—Peter M. Cuomo
*Assistant Examiner*—Monica E. Millner
*Attorney, Agent, or Firm*—Herbert Dubno; Andrew Wilford

[57] ABSTRACT

A motor-vehicle door latch bolt has a housing in which a door bolt is receivable and a latch fork formed with a seat and with at least one detent and pivotal on the housing between a locked position engaged around the bolt and holding it deep in the recess and an unlocked position permitting the bolt to move into and out of the recess. A support link pivotal on the housing carries a latch pawl pivotal into and out of a holding position engaging the detent and preventing pivoting of the fork into the unlocked position. A motor-driven crank rotatable adjacent the fork is coupled to the support link for pivoting the support link and retaining pawl as the crank rotates. An inner lever pivoted on an assembly pivot has an abutment and a detent, and is coupled to the latch pawl, and an outer lever pivoted on the assembly pivot has an abutment engageable with the inner-lever abutment, and is operable from outside the door. A crank lever pivoted on the assembly pivot has one arm connected to the support link and another arm. An opening lever pivoted on the housing has an outer end connected by an opening link to the other arm of the crank lever. A coupling pawl pivoted on the other arm of the crank lever is engageable with the detent of the inner lever.

4 Claims, 8 Drawing Sheets

MOTOR-VEHICLE DOOR LATCH WITH POWER ASSIST

FIELD OF THE INVENTION

The present invention relates to a motor-vehicle door latch. More particularly this invention concerns such a latch having a motor that can open and close it.

BACKGROUND OF THE INVENTION

A power-assisted motor-vehicle door latch as described in commonly owned U.S. Pat. No. 4,892,339 has a housing formed with a laterally open recess in which the bolt is receivable, a latch fork formed with a fork seat and with at least one detent, and a fork pivot on the housing supporting the fork for pivoting between a locked and a semilocked position with the seat directed away from the fork pivot and the bolt engaged in the seat and an unlocked position permitting the bolt to enter and exit the seat and recess. An operating plate pivotal on the housing about an axis substantially parallel to the fork pivot carries the pivot of a latch pawl which is pivotal on the link plate into and out of a position engaging the detent and thereby retaining the fork in the semilocked position. A motor connected to the operating plate can pivot same about its axis and, when the pawl is engaged with the detent, pivot the fork into the locked position. A door handle and a link connected between the handle and the pawl can pivot same out of engagement with the detent in any position of the fork.

Thus with this system the operating plate is pivoted to power-close the door, thereby pivoting the pawl and using this pawl to push the fork around into the fully locked position. The user of the latch need merely push the door into the semi-locked position; the motor will take over from here and pull the door fully into the locked position.

Such an arrangement therefore moves through four positions: open, ready to latch, latched, and ready to open, and must move through them sequentially. Once the door is latched and it is to be opened by its motor, which is typical for a trunk lid or door, the mechanism must laboriously move through the ready-to-open position to the open position, entailing some delay. It is possible to avoid this by providing a separate actuator or motor to open the latch, but this increases the cost of the system intolerably.

OBJECTS OF THE INVENTION

It is therefore an object of the present invention to provide an improved motor-vehicle door latch with power assist.

Another object is the provision of such an improved motor-vehicle door latch with power assist which overcomes the above-given disadvantages, that is which operates without delay both when opening and closing.

SUMMARY OF THE INVENTION

A motor-vehicle door latch for use in combination with a door bolt has according to the invention a housing formed with a laterally open recess in which the bolt is receivable and a pivotal latch fork formed with a fork seat and with at least one detent and pivotal on the housing between a locked position engaged around the bolt and holding it deep in the recess, a semilocked position engaged around the bolt and holding it shallowly in the recess, and an unlocked position permitting the bolt to move into and out of the recess. A support link pivotal on the housing carries a latch pawl pivotal into and out of a holding position engaging the detent and preventing pivoting of the fork into the unlocked position. A crank rotatable adjacent the fork is coupled to the support link for pivoting the support link and retaining pawl as the crank rotates. A motor connected to the crank serves, when the pawl is engaged with the detent in the semilocked position of the fork, to pivot the crank and the fork into the locked position. An operating-lever assembly connected to the pawl for pivoting same out of engagement with the detent has an assembly pivot on the housing plate, an inner lever pivoted on the assembly pivot, having an abutment and a detent, and coupled to the latch pawl, and an outer lever pivoted on the assembly pivot, having an abutment engageable with the inner-lever abutment, and operable from outside the door. The assembly also has a crank lever pivoted on the assembly pivot and having one arm connected to the support link and another arm, an opening lever pivoted on the housing and having an outer end, and an opening link interconnecting the outer end of the opening lever and other arm of the crank lever. A coupling pawl pivoted on the other arm of the crank lever is engageable with the detent of the inner lever.

Thus the instant invention uses this free-running lever assembly, which can easily be added to a standard latch, so as to completely avoid the lost motion in the closing and opening phases of the latch operation. As the latch is closed the opening pawl moves into a position making the latch, the instant it is fully closed, ready to be opened. Similarly during the opening action the pawl moves into a position capable of initiating a closing action the instant the latch is fully opened. The user does not have to wait after opening or closing the latch to make the next step.

According to the invention a spring continuously urges the coupling pawl into engagement with the detent. The coupling pawl has an arm engageable with the opening link to pivot the coupling pawl out of engagement with the detent. A link is provided between the inner lever and the latch pawl.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
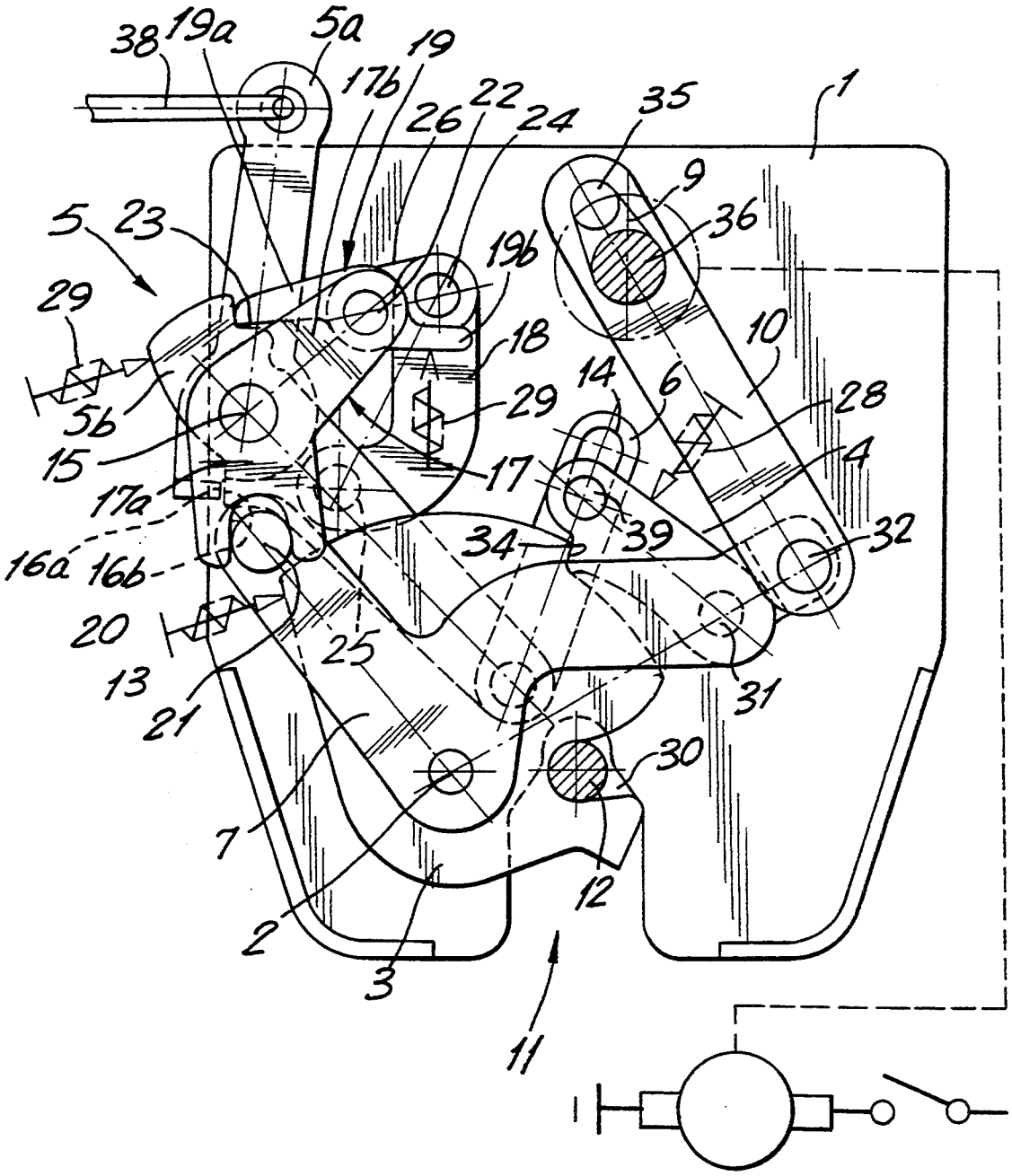
FIG. 1 is a partly diagrammatic and partly sectional view of the latch according to this invention in the position where it is closed and latched but ready to open.
Figure 2:
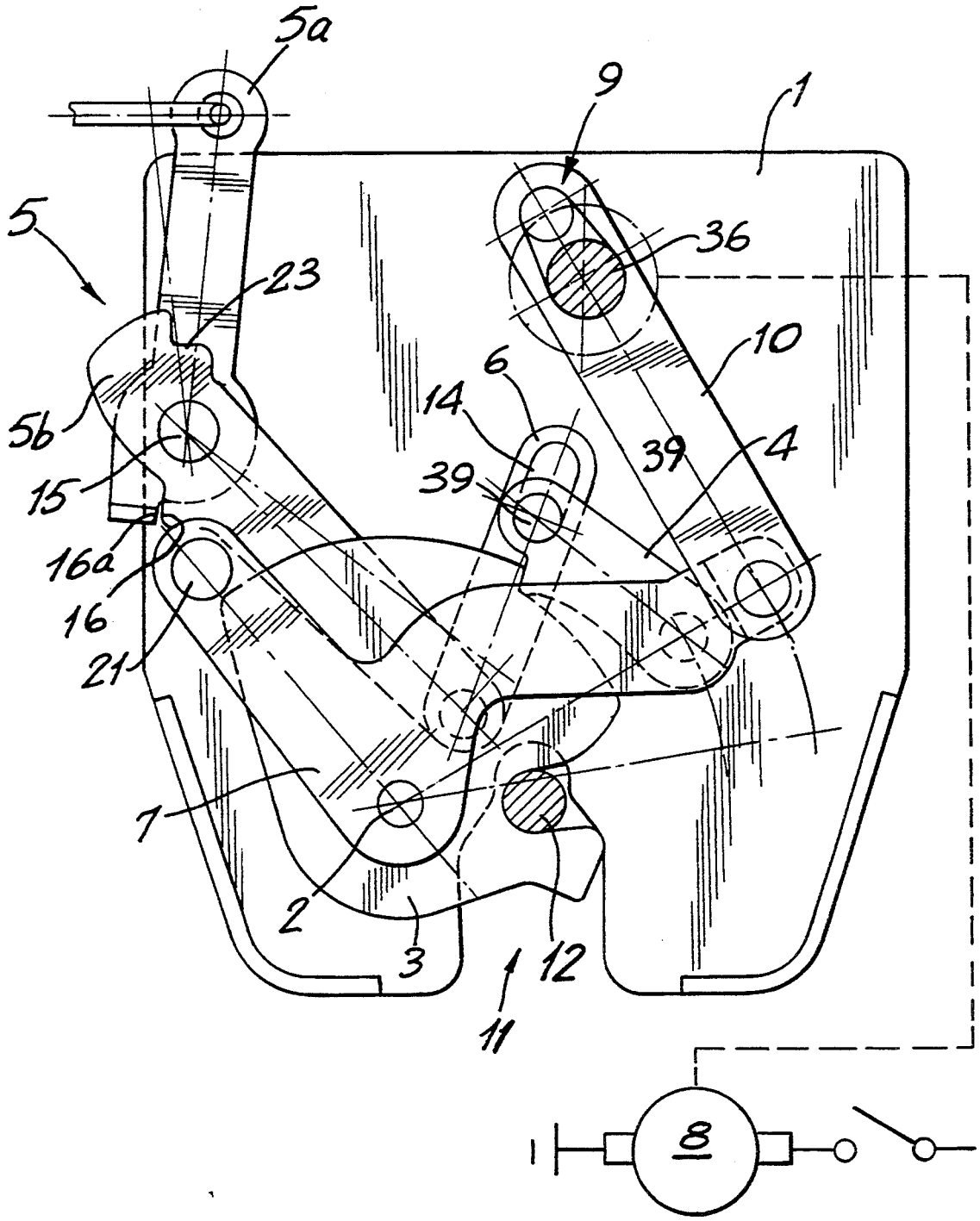
FIGS. 2 and 3 are views like FIG. 1 but with parts removed for clarity of view.
Figure 3:
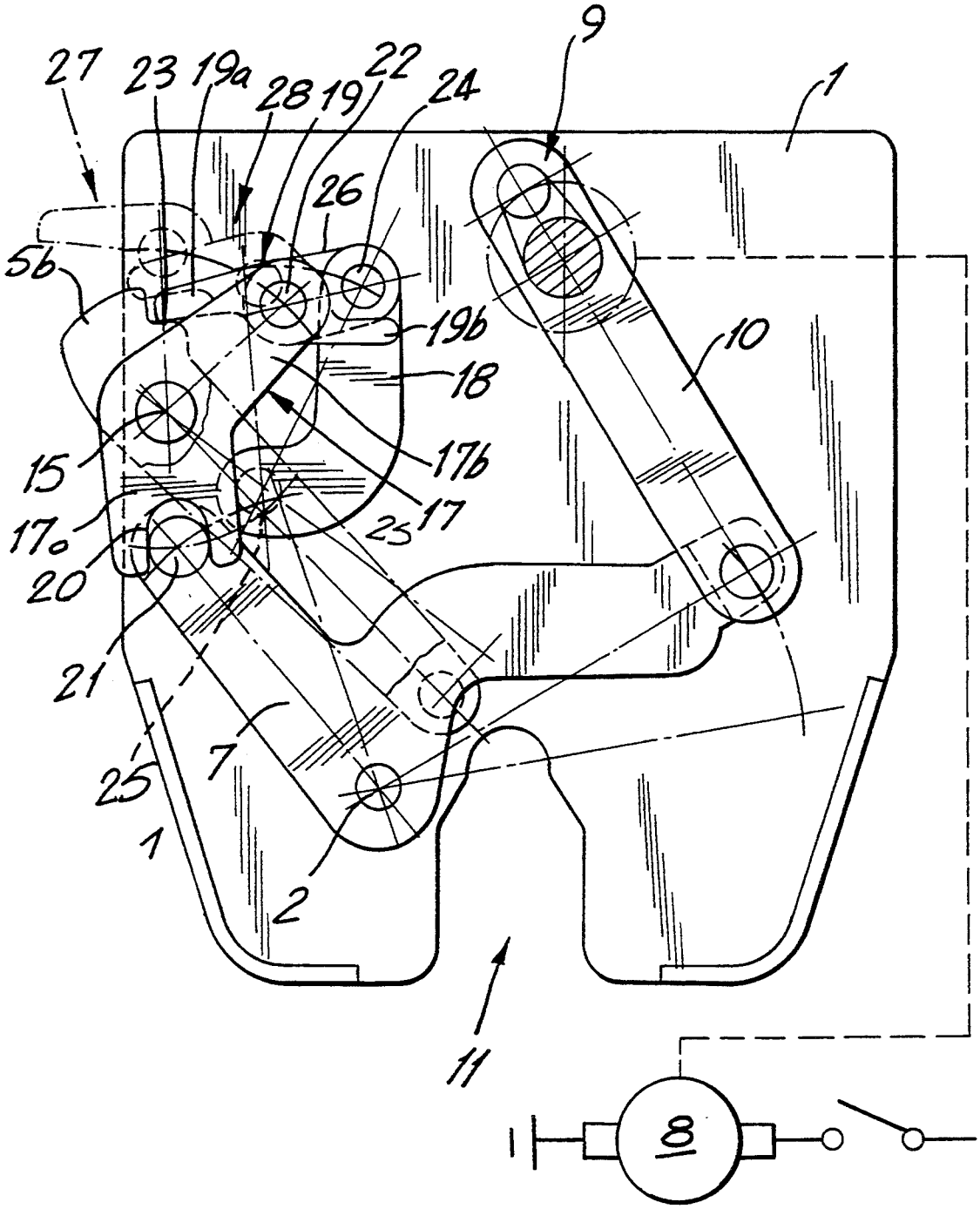

As seen in FIGS. 1 through 3 a power-assist door latch according to this invention has a housing 1 normally fixed on the edge of a vehicle door or trunk lid and provided with a latch fork 3 that is mounted on a pivot 2. The housing 1 is formed with an outwardly open notch or recess 11 in which can engage a latch bolt 12 that itself has an enlarged head and that is fixed on the edge of the door opening or post. A spring illustrated diagrammatically at 13 normally urges the fork 3 clockwise. This fork 3 is formed with a seat 30 into which the bolt 12 can fit.

A supporter link plate 7 pivotal on the pivot 2 has an outer end provided with a pivot pin 31 on which is pivoted a retaining pawl 4 and another pin 32 on which is pivoted an operating link 10. The pawl 4 has a tooth 33 engageable with a detent 34 formed on the fork 3. A spring 28 biases the pawl 4 toward the fork 3. The operating link 10 has an end opposite the pin 32 connected via a pin 35 to a crank 9 carried on a shaft 36 of a motor 8.

An outside door cylinder 37 is connected via a coupling rod 38 to a lever assembly 5 pivoted on an axle 15 on the housing 1. This assembly 5 is formed by two separate levers **5*a* and 5*b* that rotate together when the lever 5*a* is pivoted counterclockwise, but which permits counterclockwise pivoting of the lever 5*b* independently of the lever 5*a*. The lever 5*b* has an outer end pivoted to yet another link 6 having an end formed with a slot 14 in which engages a pin 39 carried on the outer end of the pawl 4. Thus if the lever assembly 5*a* is pivoted somewhat clockwise, the pawl 4 will be pushed back to disengage its tooth 33 from the detent 34. The slot 14 permits the pawl 4 to be pivoted against the force of its spring 28 into this freeing position without actuation of the lever assembly 5. In addition the cylinder 37 can move the pawl 4 into the freeing position in virtually any angular position of the link plate 7**.

A lever assembly 17 pivoted on the axle 15 of the lever 5 has a forked arm **17*a* having an end recess 20 engaged over a pin 21 carried on the link plate 7 and an opposite arm 17*b* provided with a pin 22 coupled via a link 26 to a pin 24 on the outer end of another link 18 pivoted on a pin 25 fixed on the plate 1. The pin 22 also carries a pawl 19 having one arm 19*a* engageable with a shoulder forming a detent or stop 23 formed on the lever 5*b* and an opposite arm 19*b* biased upward by a spring 29 to maintain the lever 19*a* against the arm 5*b*. This arm 19*b* can engage the pin 24 as described below. Thus as the support plate 7 rotates about its pivot 2, for instance, clockwise, the lever 17 will rotate counterclockwise and the pawl 19 will move to the left, pushing the lever 5*b*** counterclockwise also.

The latch described above operates as follows:

To start with the parts are in the position of FIGS. 1 through 3 with the fork 3 holding the bolt 12 deep in the recess 11 and the pawl 4 engaged against the stop shoulder or detent 34. The plate 7 is in its end position, rotated fully clockwise, and the pawl 19 is blocked against the shoulder 23. In this position actuation of the cylinder 37 to rotate the lever **5*a* counterclockwise will bring an abutment 16*a* on this lever 5*a* into angular engagement with an abutment 16*b* on the lever 5*b*, causing it to rotate counterclockwise also and lift the link 6 so that the pin 39 raises the pawl 4 off the fork 3**, allowing the latch to open. This manual operation is possible in virtually any closed position of the latch.

Figure 4:
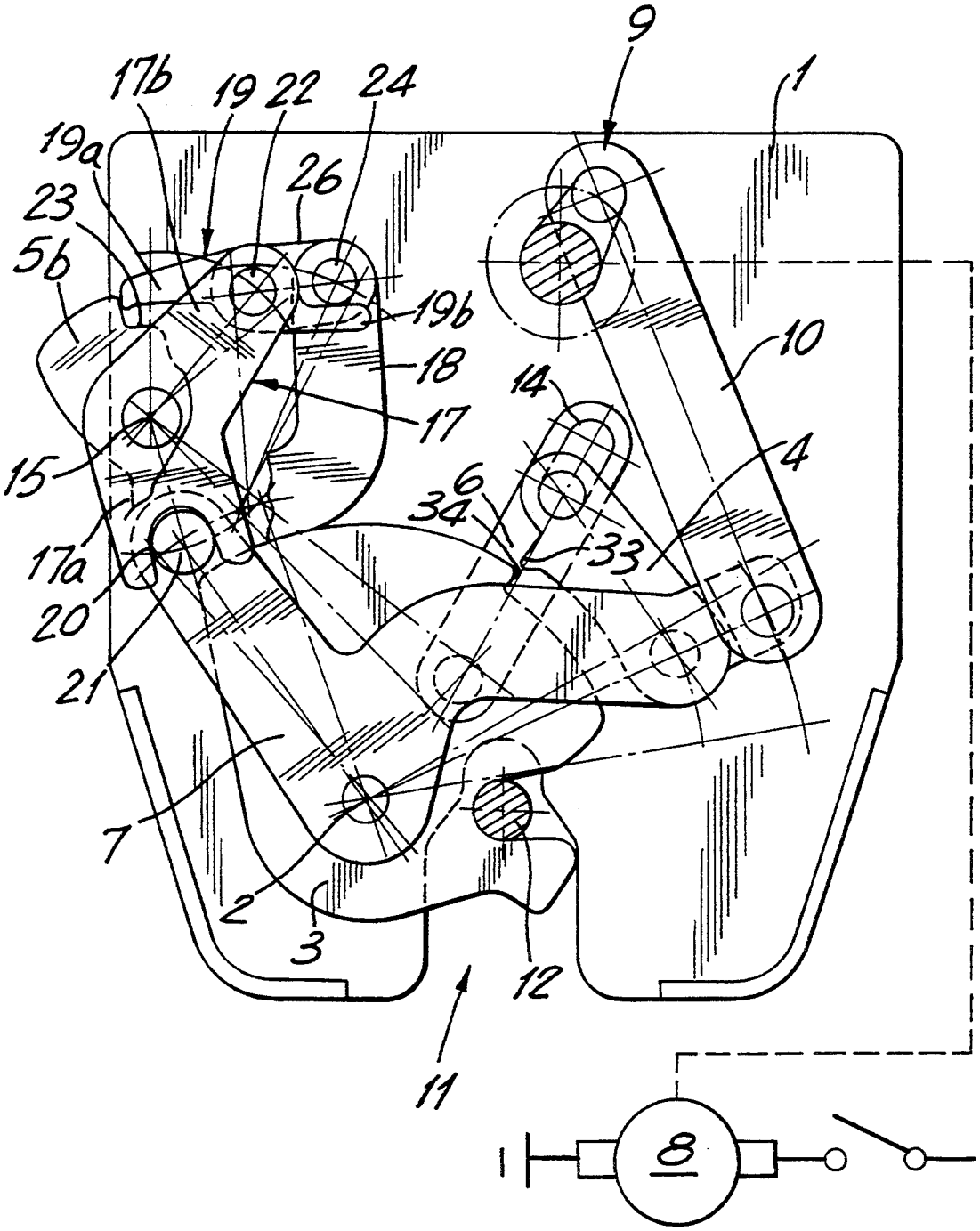
FIG. 4 is a view like FIG. 1 but with the latch shown at the instant the fork is released.

For power-assisted opening of the latch as shown in FIG. 4 the motor 8 rotates the crank 9 somewhat clockwise to push the support plate 7 clockwise also. The lever 17 engaged over the pin 21 will rotate oppositely and will push the pawl 19 against the stop 23 to pivot the lever **5*b* counterclockwise. This pushes up the link 6 and disengages the tooth 33 of the pawl 4 from the detent 34. Thus at the very start of the rotation of the crank 9 the fork 3** is released.

Figure 5:
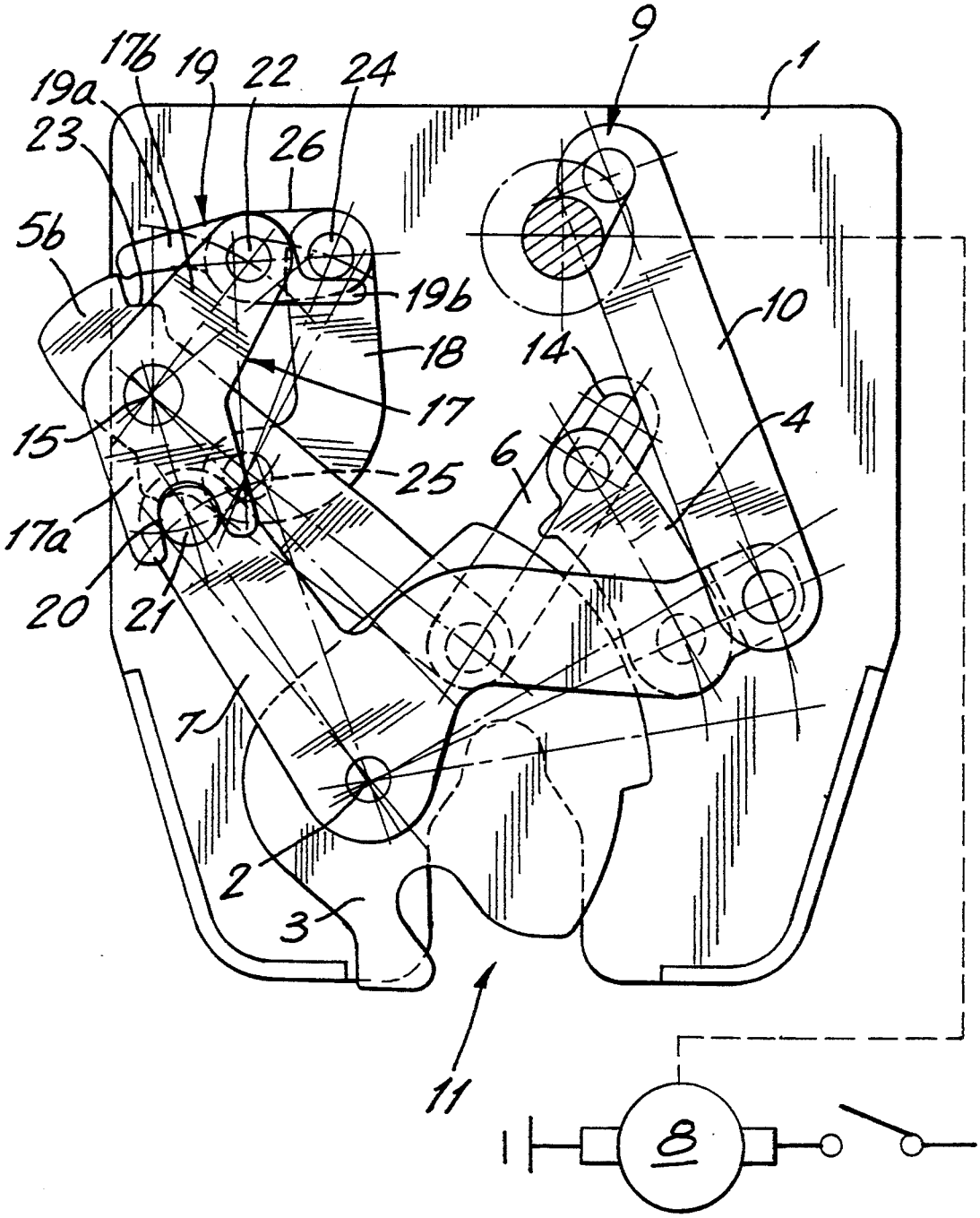
FIG. 5 shows the latch in the open position shortly after the fork has been released.

Since there is at this time nothing restraining rotation of the fork 3, and presumably there is even something urging it outward, the fork 3 immediately pivots around to the position of FIG. 5. Meanwhile the crank 9 continues to rotate so that the arm **19*b* engages the pin 24 which causes the lever 19 to pivot clockwise, starting to pull its arm 19*a* off the detent 23**.

Figure 6:
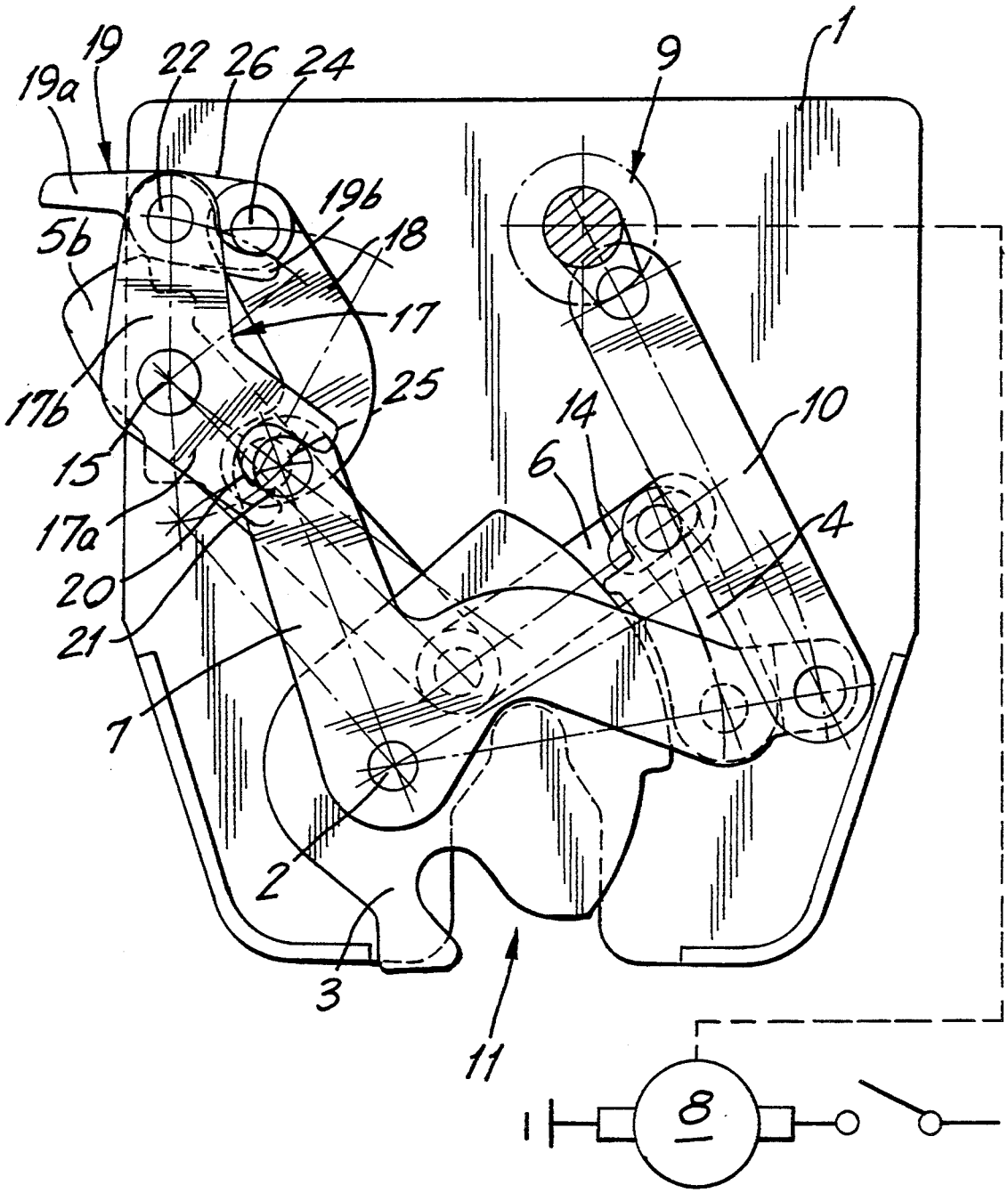
FIG. 6 shows the latch in the fully open position and ready to close.

Subsequently as seen in FIG. 6 continued rotation of the crank 9 to its one end position causes the lever 19 to flip up over the detent 23 so that the arm **5*b* can snap back under the force of its spring 13 (FIG. 1**) to its starting position. This is the open position of the latch in which it sits.

Figure 7:
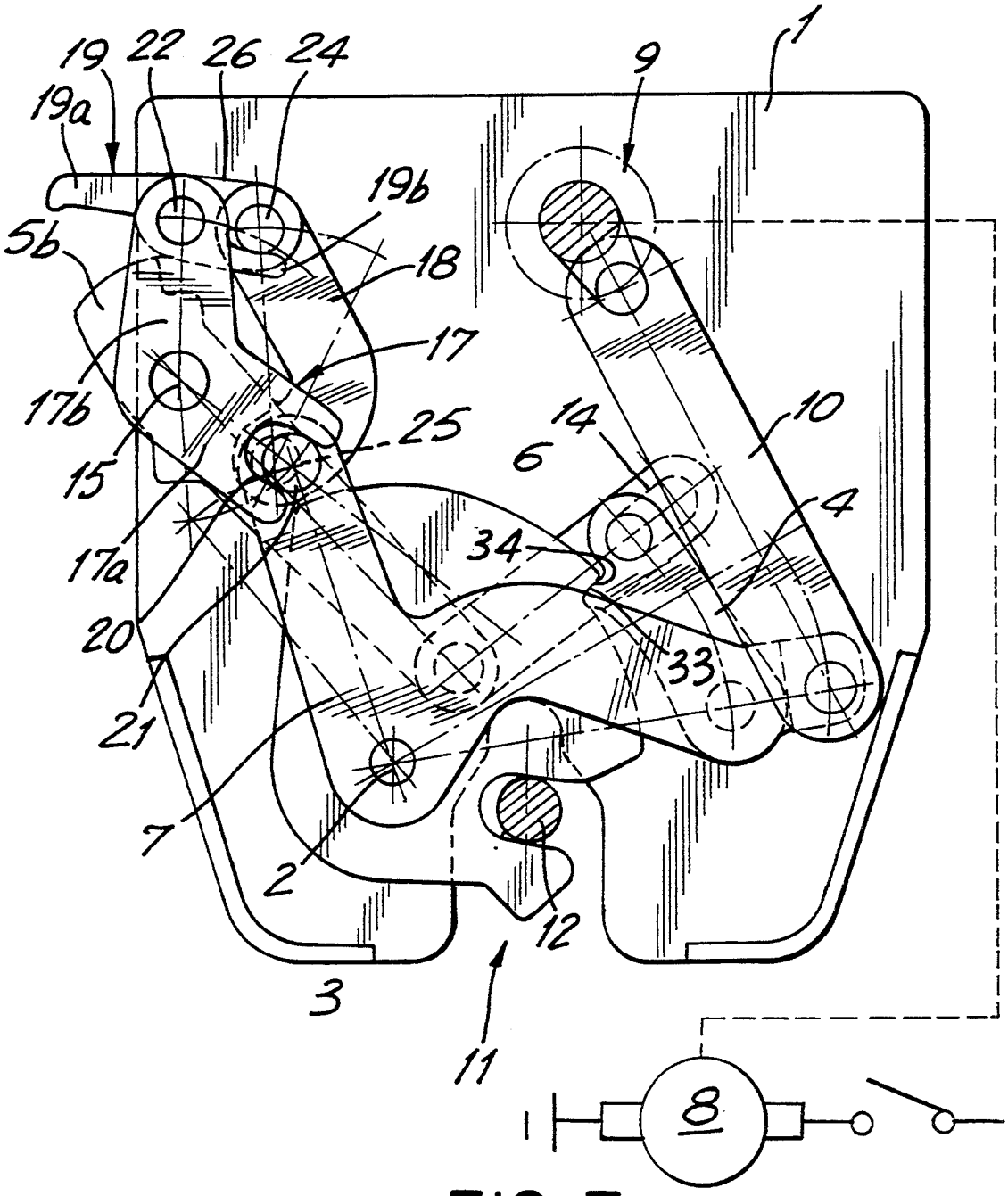
FIGS. 7 and 8 show the latch in sequential stages as it closes, shortly before returning to the position of FIG. 1.

FIG. 7 shows how, with no further rotation of the crank 9, the bolt 12 can re-enter the notch 11 of the housing 1 and the recess or seat 30 of the fork 3 to rotate this fork 3 back counterclockwise until the detent 34 slips back under the tooth 33 of the spring-loaded pawl 4. In this position the door, normally a trunk lid, carrying the latch is held closed but is not tightly closed.

Figure 8:
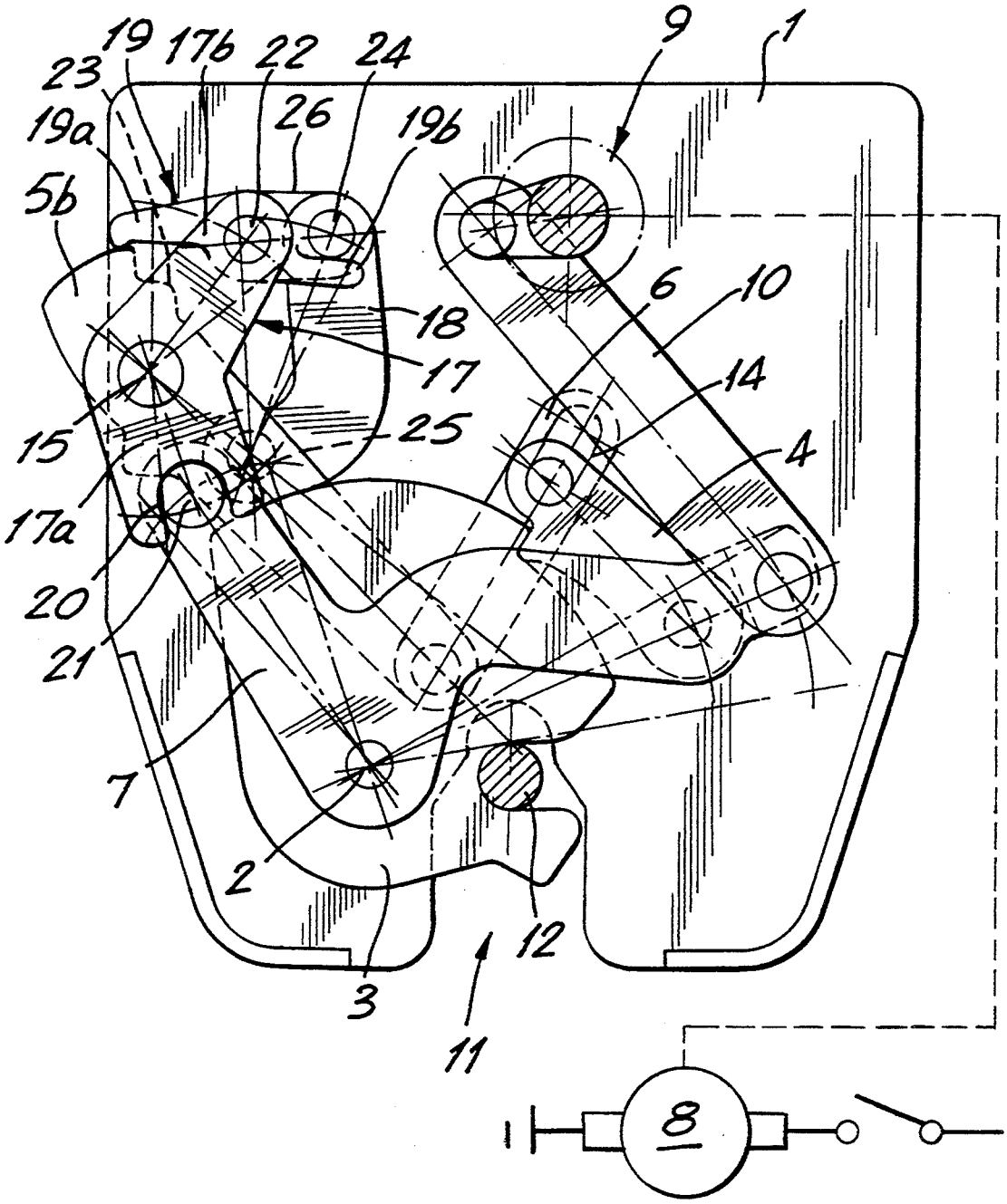

An unillustrated switch is tripped in the FIG. 7 position to restart the motor 8 which rotates the crank 9 through 180° to the FIG. 1 position, with the crank 9 traveling in the same clockwise direction as earlier. As seen in FIG. 8 this rotation, to start with, pushes the pawl 4 over to pivot back the fork 3 and pull the bolt 12 deep into the recess 11, tightly closing the door in question. Simultaneously this counterclockwise rotation of the plate 7 is translated into clockwise rotation of the lever 17, pulling back the pawl 19 and allowing its arm **19*a* to drop behind the detent 23, The parts are restored to the FIG. 1** position, ready to open again.

Important to the invention is that there is no need for any travel of the crank 9 to reset the latch once it reaches the FIG. 7 position so that it can be power latched, and similarly no further travel of the crank is necessary to go from the full-closed/ready-to-open position of FIGS. 1 to 3 to the bolt-released position of FIG. 4.

I claim:

1. A motor-vehicle door latch for use in combination with a door bolt, the latch comprising:

a housing formed with a laterally open recess in which the bolt is receivable;

a pivotal latch fork formed with a fork seat and with at least one detent;

a fork pivot supporting the fork on the housing for pivoting between a locked position engaged around the bolt and holding it deep in the recess, a semilocked position engaged around the bolt and holding it shallowly in the recess, and an unlocked position permitting the bolt to move into and out of the recess;

a support link pivotal on the housing;

a latch pawl;

a pawl pivot fixed on the support link offset from the fork pivot and supporting the latch pawl on the support link for pivoting in the locked and semilocked positions of the fork into and out of a holding position engaging the detent and preventing pivoting of the fork into the unlocked position;

a crank rotatable on the housing adjacent the fork through 360°;

means coupling the crank to the support link for pivoting the support link and latch pawl as the crank rotates;

means including a motor shaft carrying the crank for, when the latch pawl is engaged with the detent in the semilocked position of the fork, pivoting the crank and the fork into the locked position;

an operating-lever assembly connected to the latch pawl for pivoting same out of engagement with the detent, the assembly including an assembly pivot on the housing, an inner lever pivoted on the assembly pivot, having an abutment and a detent, and coupled to the latch pawl, and an outer lever pivoted on the assembly pivot, having an abutment engageable with the inner-lever abutment, and operable from outside the door;

a crank lever pivoted on the assembly pivot and having one arm connected to the support link and another arm;

an opening lever pivoted on the housing and having an outer end;

an opening link interconnecting the outer end of the opening lever and the other arm of the crank lever; and a coupling pawl pivoted on the other arm of the crank lever and engageable with the detent of the inner lever.

2. The latch defined in claim 1, further comprising a spring urging the coupling pawl into engagement with the detent.

3. The latch defined in claim 2 wherein the coupling pawl has an arm engageable with the opening link to pivot the coupling pawl out of engagement with the detent.

4. The latch defined in claim 1, further comprising a link between the inner lever and the latch pawl.

* * * * *